United States Patent [19]

Corbett et al.

[11] Patent Number: 4,915,603

[45] Date of Patent: Apr. 10, 1990

[54] ROTARY ENGINE COOLING SYSTEM

[75] Inventors: William D. Corbett; Benjamin L. Sheaffer, both of Fond du Lac, Wis.

[73] Assignee: Brunswick Corporation, Skokie, Ill.

[21] Appl. No.: 226,686

[22] Filed: Aug. 1, 1988

[51] Int. Cl.[4] ..... F01C 21/06

[52] U.S. Cl. ..... 418/83; 418/88

[58] Field of Search ..... 418/83, 88; 123/41.31

[56] References Cited

U.S. PATENT DOCUMENTS

| | | | |
|---|---|---|---|
| 3,007,460 | 11/1961 | Bentele et al. | 418/83 |
| 3,280,802 | 10/1966 | Froede | 418/83 |
| 3,286,700 | 11/1966 | Froede | 418/83 |
| 3,644,070 | 2/1972 | Lermusiaux | 418/83 |
| 3,691,999 | 9/1972 | Lechler et al. | 418/83 |
| 3,895,889 | 7/1975 | Loyd, Jr. et al. | 418/83 |
| 3,975,122 | 8/1986 | Hackbarth et al. | 418/83 |
| 4,215,534 | 8/1980 | Silvestri | 418/83 |
| 4,312,304 | 1/1982 | Tynei | 123/41.31 |
| 4,779,578 | 10/1988 | Eiermann | 418/83 |

*Primary Examiner*—Donald E. Stout
*Assistant Examiner*—Timothy S. Thorpe
*Attorney, Agent, or Firm*—Andrus, Sceales, Starke & Sawall

[57] ABSTRACT

A cooling water system for a rotary internal combustion engine includes initial direct water cooling for the outer surface of the exhaust manifold with the cooling water directed therefrom to serially interconnected cooling water passages in the various housing elements comprising the engine block. The cooling water passage in each housing element is circumferentially disposed along the peripheral portion of the housing which is directly adjacent the high temperature exhaust and combustion areas of the engine rotor chamber. The cooling system thus supplies water directly to the portions of the engine subject to the highest operating temperatures. The system also includes protection against the formation of hot air or steam pockets and the cooling system is readily adaptable to both single and twin rotor engines.

3 Claims, 4 Drawing Sheets

ROTARY ENGINE COOLING SYSTEM

BACKGROUND OF THE INVENTION

The present invention relates to a cooling system for a rotary internal combustion engine and, more particularly, to a water cooling system for a rotary engine especially suited to marine applications.

The rotary internal combustion engine or Wankel engine has gained significant acceptance and has been used more widely in automotive applications in recent years. One of the major attractions of the rotary engine is the relative simplicity of its construction as compared to the more conventional reciprocating piston engines. In addition, advances in engineering have eliminated or substantially alleviated design and operational problems previously associated with rotary piston engines, such as rotor seal efficiency and life. As a result, additional applications for rotary piston engines are being explored and adopted. One particularly attractive application for the rotary engine is marine use and, in particular, in outboard boat motors.

Although many automotive applications for rotary piston engines allow them to be air-cooled, there are both practical and manditory reasons for utilizing water cooling for rotary engines in marine applications. From a practical standpoint, there is a ready supply of water available for the cooling system in a marine engine. In addition, there are certain parts of any marine engine, which would include a rotary engine, that must be so thoroughly cooled that air-cooling would be ineffective and unacceptable. One such area of a marine engine is the exhaust manifold which, by U.S. Coast Guard regulation, cannot be hot and can only be effectively cooled to the required temperature level by water cooling.

Thus, a water cooling system for a rotary piston engine used in an outboard boat motor must not only provide the required cooling for the hot exhaust manifold, but should also utilize the water to effectively cool other high operating temperature parts. However, the cooling system should also be relative simple so as not to unduly complicate the relatively simple construction of the rotary piston engine. Further, the water cooling system should be adaptable for application to either a single or a double rotor engine, these being the only two of any significant practical application.

SUMMARY OF THE INVENTION

In accordance with the present invention, a water cooled rotary engine includes an intermediate rotor housing (or two such housings in the case of a twin rotor engine) which rotor housing defines a central opening comprising the rotor chamber, and an outer housing attached to each of the opposite faces of the rotor housing to overlie and partially enclose the rotor chamber. An exhaust gas outlet from the rotor chamber extends through the rotor housing and into communication with the exhaust manifold attached to the outside of the engine. The exhaust manifold includes an integral water jacket surrounding the outer surface and adapted to receive a supply of engine cooling water, pumped into the water jacket via a conventional water pump. The outlet end of the water jacket is attached to an opening in the rotor housing, preferably adjacent and surrounding the exhaust gas outlet. Each of the rotor and outer housings includes separate internal cooling water passages which are circumferentially disposed along a peripheral portion of the housing and line generally adjacent the exhaust and combustion areas of the rotor chamber as well as adjacent one another. One end of the cooling water passage in one of the housings is connected to the inlet from the exhaust manifold water jacket and all of the cooling water passages are serially connected at one end to the end of an adjacent cooling water passage by interconnecting transfer passages.

The supply of engine cooling water is thus circulated around around and past the exhaust manifold to provide the required cooling, and then serially through interconnected passages in each of the housings which passages are disposed around the peripheral portions of the housings which are subjected to the highest temperatures during engine operation. Preferably, the cooling water inlet to the engine from the water jacket around the exhaust manifold is in the rotor housing and surrounds the exhaust gas outlet which is typically an area subjected to high operating temperatures.

The water cooling system of the present invention is readily adaptable to one and two rotor engine designs and is particularly well suited to the engine orientation with the rotor shaft vertically disposed which is most suitable for use in an outboard motor. The vertical engine orientation requires the various engine housing parts to be vertically stacked and the attached exhaust manifold to extend vertically downward along the side of the engine. In this manner, the flow of engine cooling water from a water pump disposed in the conventional position near the lower end of the outboard motor enters the lower end of the water jacket, exits the upper end thereof and enters the uppermost (or single) rotor housing, and then flows downwardly into the cooling water passage in the lowermost outer housing for continued flow in an upwardly serpentine path through the serially interconnected cooling water passages in adjacent housings. Water is discharged from the system through the uppermost outer housing where it may be returned downwardly into the driveshaft housing for discharge below the water level in a conventional manner.

The engine cooling system of the present invention also includes protection against formation of hot air or steam pockets which inhibit cooling water contact. Also, in the twin rotor engine, means are provided to allow direct cooling water contact with the exhaust gas outlet from the lower rotor housing immediately upon engine startup and until full cooling water circulation in the system is established.

DETAILED DESCRIPTION OF THE PREFERRED EMBODIMENT

Figure 2:
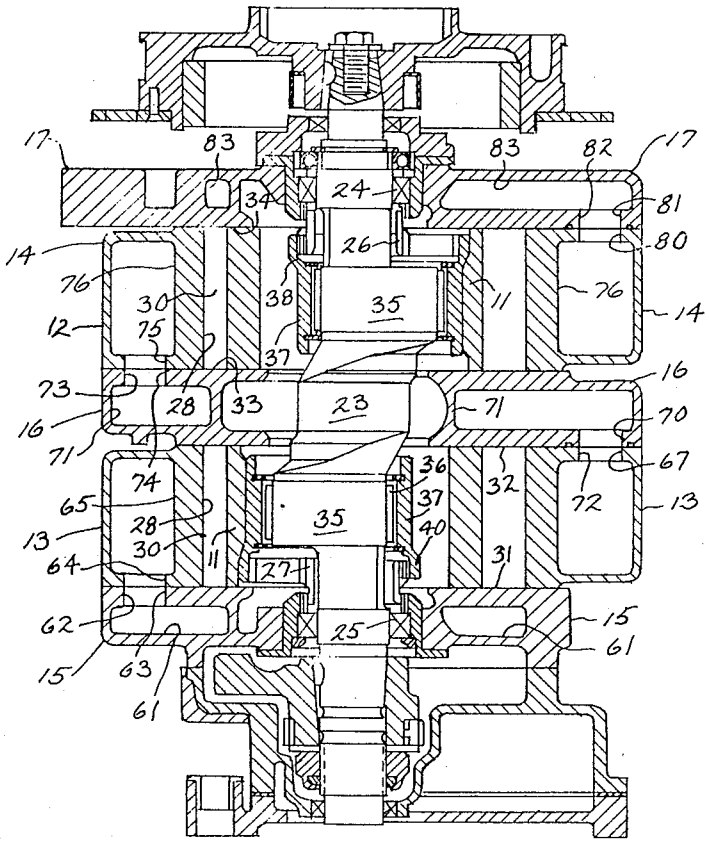
FIG. 2 is a vertical section taken on line 2—2 of FIG. 1.
Figure 1:
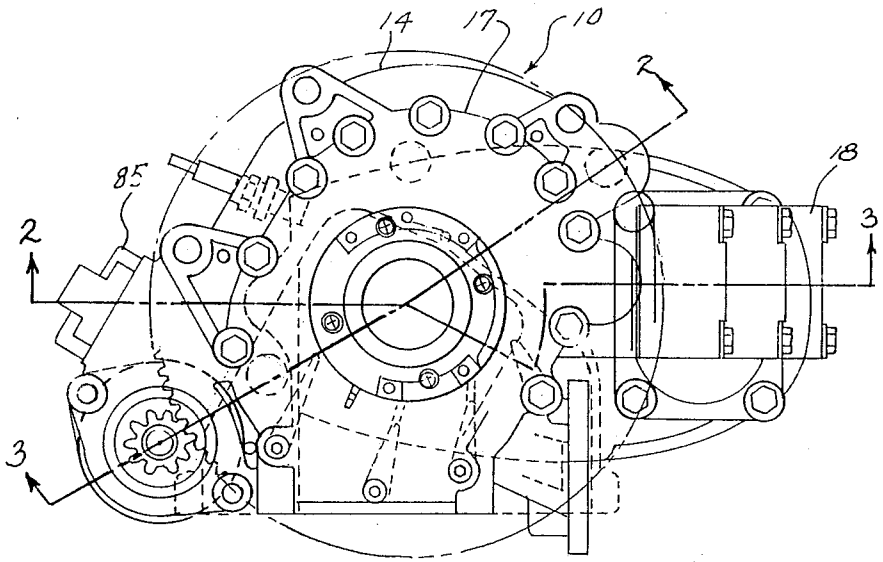
FIG. 1 is a top plan view of a rotary engine having its rotor shaft disposed vertically.
Figure 4:
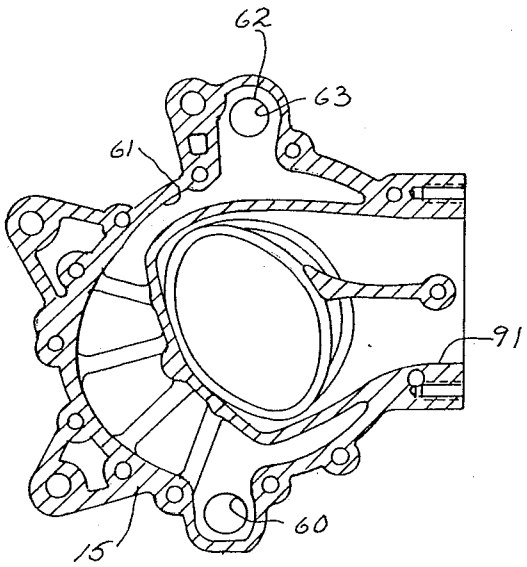
FIG. 4 is a horizontal section taken on line 4—4 of FIG. 1.
Figure 3:
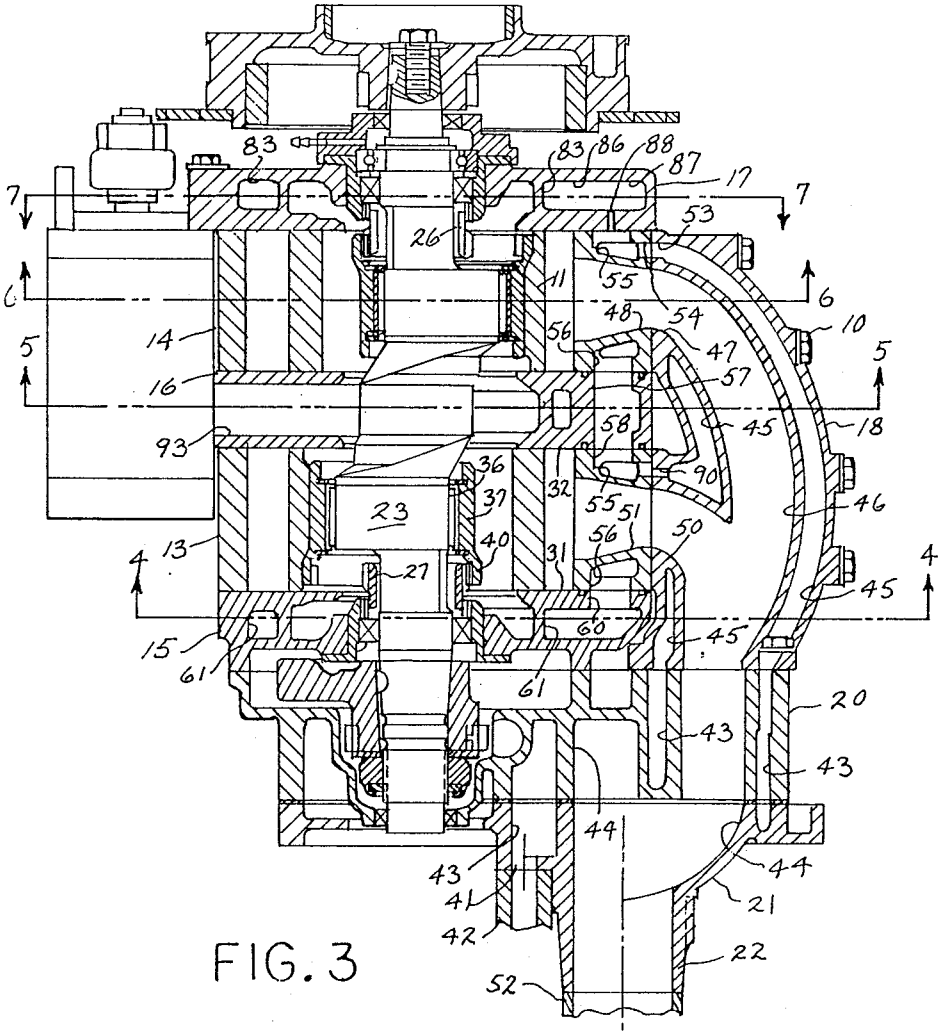
FIG. 3 is a vertical section taken on line 3—3 of FIG. 1.

A rotary engine 10 of the type having two rotors 11 includes an engine block 12 comprising a vertically disposed stack of block components. Each of the block components is a separate casting, preferably made of aluminum. Alternately, some or all of the block components may comprise two-piece castings.

The engine block 12 includes a lower rotor housing 13 and an upper rotor housing 14 which are identical. A lower housing 15 is attached to the lower face of the lower rotor housing 13, a center housing 16 is disposed between and attached to the opposite faces of the lower and upper rotor housings 13 and 14, respectively, and an upper housing 17 is attached to the upper face of the upper rotor housing 14.

An exhaust manifold 18 is attached to the outside of the engine block 12 and extends vertically downwardly from approximately the top of the upper rotor housing 14 to the bottom of the lower housing 15 where it joins and is attached to an adapter plate 20. An exhaust extension 21 is attached to the lower face of the adapter plate 20. When the engine 10 is adapted for use in an outboard motor, the lower end of the exhaust extension 21 extends downwardly into the drive shaft housing of the motor in a conventional manner as is well known in the art.

Each of the housing elements 13–17 and the exhaust manifold elements 18, 20 and 21 are conveniently made from aluminum castings. The light weight of aluminum is, of course, advantageous and, in marine applications, the corrosion resistance of aluminum is also important.

Each of the housings comprising the engine block is provided with a generally centrally located opening to accommodate the rotor 11 and rotor shaft 23 assembly. The rotor shaft 23 extends through the engine block 12 and is journalled for rotation therein on upper and lower bearings 24 and 25 mounted in the central openings in the upper and lower housings 17 and 15, respectively. Upper and lower stationary gears 26 and 27 are attached to the upper and lower housings concentrically with the upper and lower bearings and with the axis of rotation of the rotor shaft 23.

Each of the lower and upper rotor housings 13 and 14 includes an enlarged central opening 28 which defines the epitrochoidal rotor chamber 30, the configuration of which is conventional in rotary engine construction. Portions of the housing elements 15–17 lying adjacent the upper and lower faces of each rotor housing overlie portions of the central openings 28 therein and serve to define the lateral walls of the rotor chamber 30. For example, the upper surface 31 of the lower housing 15 and the lower surface 32 of the center housing 16 extend radially inwardly beyond the central opening 28 defining the rotor chamber 30 to provide the lower and upper walls of the lower rotor chamber 30. Likewise, the upper surface 33 of the center housing and the lower surface 34 of the upper housing 17 extend radially inwardly beyond the vertical walls of the upper rotor chamber 30 to define the lower and upper walls, respectively, thereof.

In the engine orientation shown, the rotor shaft 23 extends vertically through the engine block 12 and includes an enlarged cylindrical eccentric portion 35 disposed within each rotor chamber 30. A rotor 11 is rotatably mounted on each cylindrical eccentric 35 by a needle bearing assembly 36 carried by a cylindrical ring 37 attached to the cylindrical I.D. of the rotor 11. The cylindrical rings 37 for each of the upper and lower rotors 11 include an integral upper rotor gear 38 and lower rotor gear 40, respectively. Each of the cylindrical rings 37 including the integral rotor gears 38 and 40 is identical in construction. However, the upper cylindrical ring 37 is disposed such that the upper rotor gear 38 extends axially upwardly to surround and with its teeth engaging the teeth of the upper stationary gear 26. Similarly, the lower rotor gear 40 extends axially downwardly and surrounds and engages the lower stationary gear 27. The diameter of the upper and lower rotor gears 38 and 40 is substantially larger than that of the upper and lower stationary gears 26 and 27 and results in the eccentric rotary movement of the rotors 11 within the rotor chambers 30 in a manner conventional to the operation of a rotary engine.

Near the lower end 22 of the exhaust extension 21 is a cooling system water inlet 41. A cooling water supply conduit 42 extends downwardly from the cooling system inlet 41 to a water pump disposed in the lower portion of the drive shaft housing in a manner conventional in outboard motor construction. Cooling water entering the cooling system inlet 41 passes first into an interior cooling water chamber 43 within adjoining portions of the exhaust extension 21 and adapter plate 20 and surrounding a common exhaust chamber 44 which is also common to the interiors of the exhaust extension and adapter plate. From the cooling water chamber 43, the cooling water flows upwardly into a cooling water jacket 45 surrounding the exhaust passage 46 in the exhaust manifold 18. The exhaust passage 46 includes an upper exhaust inlet 47 adjacent and in direction communication with an exhaust outlet 48 from the upper rotor chamber 30. The exhaust passage 46 also includes a lower exhaust inlet 50 in communication with a lower exhaust outlet 51 from the lower rotor chamber 30. Exhaust gases from the rotor chamber enter exhaust outlets 48 and 51, pass into the exhaust passage inlets 47 and 50, travel downwardly through the exhaust passage 46, into the exhaust chamber 44 in the adapter plate 20 and the exhaust extension plate 21, and exit from the lower end 22 of the exhaust extension 21. In a manner known in the art, an exhaust tube 53 carries the exhaust gases exiting the lower end 22 of the exhaust extension downwardly into the drive shaft housing for discharge below the water level.

At the upper end of the cooling water jacket 45 and above the upper exhaust inlet 47, there is a cooling water jacket outlet 53 by which the flow of cooling water is transferred from the exhaust manifold to the engine block 12. The jacket outlet 53 is disposed in open communication with a rotor housing cooling water inlet 54 in the upper rotor housing 14 just above the upper exhaust outlet 48 therefrom. The rotor housing cooling water inlet 54 opens into an annular chamber 55 which completely encircles the upper exhaust outlet 48. At the bottom of the annular chamber 55 is a cooling water outlet 56 from the upper rotor housing opening directly to a through passage 57 in the center housing 16. Cooling water exiting the annular chamber 55 via outlet 56 flows through the through passage 57 and into an inlet 58 at the top of the annular chamber 55 surrounding the lower exhaust outlet 51 in the lower rotor chamber 30. The lower rotor housing 13, which is identical to the upper rotor housing 14, includes an outlet 56 at the bottom of the annular chamber 55 in direct communication with a lower housing cooling water inlet 60.

Each of the housing members 13–17 comprising the rotary engine block 12 includes a generally circumferentially disposed cooling water passage which extends along a peripheral portion of the housing and is serially interconnected to the cooling water passage in an adjacent housing member by an appropriate cooling water transfer passage means. In addition, each of the circumferential cooling water passages extends over substantially the same peripheral portion of the engine block such that the passages are in substantial vertical alignment in the assembled engine.

More specifically, a lower housing cooling water passage 61 receives cooling water via the cooling water inlet 60 and extends circumferentially around a substantial portion of the periphery of the lower housing to a transfer passage 62 between the lower housing 15 and the immediately adjacent lower rotor housing 13. The transfer passage 62 comprises an upper outlet 63 from the lower housing 13 and a lower inlet 64 to the lower rotor housing 13.

Figure 6:
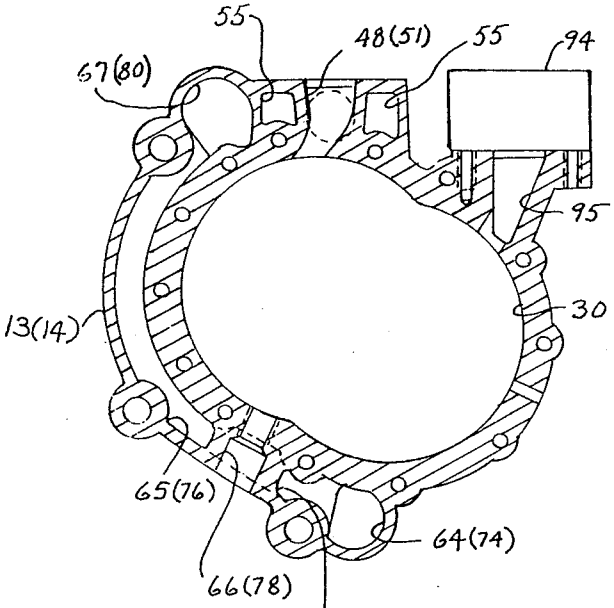
FIG. 6 is a horizontal section taken on line 6—6 of FIG. 2.
Figure 7:
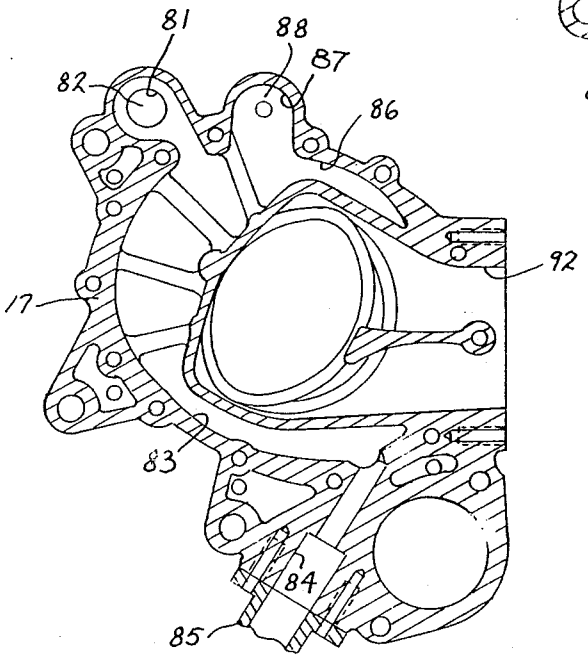
FIG. 7 is a horizontal section taken on line 7—7 of FIG. 2.
Figure 5:
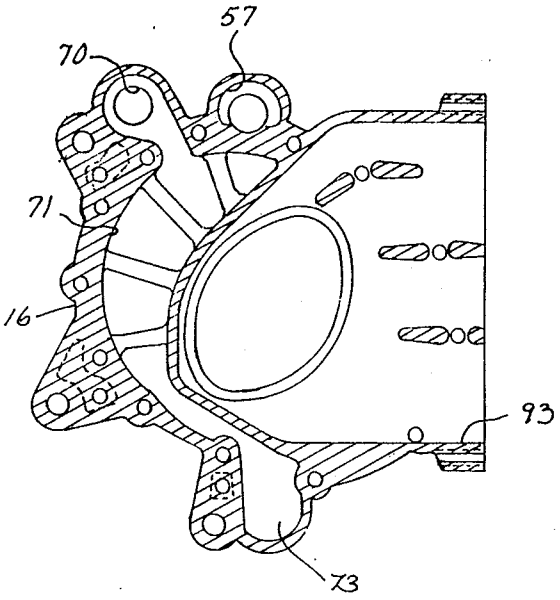
FIG. 5 is a horizontal section taken on line 5—5 of FIG. 2.

The lower inlet 64 opens into the lower rotor housing cooling water passage 65 which extends circumferentially along a substantial peripheral portion of the rotor chamber 30. In particular and with respect to the direction of rotation of the engine rotor 11, the cooling water passage 65 in the lower rotor housing 13 extends from the lower inlet 64 just to the rear of the spark plug opening 66 to an upper outlet 67 adjacent to but separated from the annular chamber 55 surrounding the lower exhaust outlet 51. Thus, as may be seen with particular reference to FIG. 6, the lower rotor housing cooling water passage 65 is disposed directly adjacent to the ignition or combustion and exhaust regions of the rotor chamber 30. These are the regions of the rotor housing and engine block generally which are typically subject to the highest engine operating temperatures. Because the cooling water passage 65 extends circumferentially in both directions from the spark plug opening 66, it includes an annular passage 68 which surrounds the spark plug opening and accommodates the flow of cooling water around it.

The flow of cooling water exits the lower rotor housing 13 and enters the center housing 16 via a transfer passage 72. Transfer passage 72 comprises aligned upper outlet 67 from cooling water passage 65 and a lower inlet 70 to the cooling water passage 71 in the center housing 16. Cooling water passage 71, like the similar passages 61 and 65 in the lower housing and lower rotor housing, respectively, extends generally circumferentially around a peripheral portion of the center housing. Also, because the cooling water passage 71 in the center housing 16 overlies and is generally coextensive with the adjacent underlying cooling water passage 65 in the lower rotor housing 13, it also provides cooling directly to the higher temperature combustion and exhaust regions of the engine block 12. Similarly, the flow of cooling water through the cooling water passage 71 in the center housing 16 provides cooling to the upper rotor housing 14, as will be described.

Cooling water from cooling water passage 71 in the center housing 16 flows into the upper rotor housing cooling water passage 76 via transfer passage 73. Transfer passage 73 comprises the aligned combination of an upper outlet 74 in the center housing and a lower inlet 75 in the upper rotor housing 14. Circumferentially disposed cooling water passage 76 in the upper rotor housing 14 is identical to the cooling water passage 65 in the lower rotor housing 13 previously described. Thus, cooling water passage 76 includes an annular passage 77 around the spark plug opening 78 and terminates in an upper outlet 80 at its downstream end, all of which elements are identical to those described for the lower rotor housing.

The cooling water flow exiting the upper rotor housing 14 flows upwardly through a transfer passage 81 formed from the sligned combination of the upper outlet 80 in the upper rotor housing and a lower inlet 82 in the upper housing 17. The upper housing also includes a circumferential cooling water passage 83 disposed around a peripheral portion of the housing. The upper housing cooling water passage 83 comprises the uppermost flow path in the cooling system and the final branch before the heated cooling water is discharged. A discharge outlet 84 is located near the downstream end of the cooling water passage 83. Discharge outlet 84, in turn, is connected to a discharge conduit 85 which carries the heated cooling water downwardly for discharge into the drive shaft housing in a conventional and well-known manner.

The upper housing cooling water passage 83 is also extended from the lower inlet 82 in a direction opposite the discharge end. This passage extension 86 includes an enlarged area 87 which overlies the annular chamber 55 adjacent the cooling water inlet 54 in the upper rotor housing 14. The cooling water passage extension 86 provides extended cooling water contact immediately above the hot exhaust region of the rotor chamber 30 in the upper rotor housing. A small diameter air vent 88 extends downwardly from the enlarged area 87 in the passage extension 86, through the lower surface 34 of the upper housing 17, and into open communication with the upper portion of the annular chamber 55 surrounding the upper exhaust outlet from the rotor chamber 30. Because the initial flow of cooling water into the engine block occurs at the cooling water inlet 54 in the upper rotor housing and is immediately diverted downwardly through the annular chamber 55, there is a tendency for air or steam pockets to form in the upper portion of the annular chamber 55 under the lower surface 34 of the upper housing 17. The air vent 88 allows trapped air or steam to escape into the upper housing cooling water passage 83 and to be eventually vented from the engine block via the cooling water discharge outlet 84. Otherwise, such air or steam pockets prevent direct cooling water contact with portions of the engine block and would result in overheating or localized burning.

In the cooling water jacket 45 surrounding that portion of the exhaust manifold 18 immediately above the lower exhaust inlet 50, there is a small diameter cooling water bleed opening 90 extending into the open upper portion of the annular chamber 55 surrounding the lower exhaust outlet 51 from the rotor chamber of the lower rotor housing 13. On initial engine startup and until the pump provides full flow of cooling water through the system, an initial lack of cooling water in the rapidly heated regions of the engine may cause detrimental over-heating. The cooling water bleed opening 90 allows an initial small flow of cooling water directly to the exhaust region of the lower rotor housing. This provides initial interim cooling until full cooling system flow is attained.

Supplemental cooling of the rotary engine may be provided by air flow. The open interiors of the various housing elements 13–17 needed to accommodate the eccentric rotation of the rotors 11 and rotor shaft 23 results in substantial open interior regions through which cooling air can be forced to circulate. In the twin rotor engine described above, cooling air may be brought into the engine via the lower and upper housings 15 and 17 and discharged via the center housing 16. Alternately, the cooling air flow may be reversed such that intake cooling air is brought in through the center housing and split into downward and upward air flows for discharge out through the lower and upper housings, respectively. No internal structural modification of the engine is necessary to accommodate air flow in both directions.

With a cooling air flow brought in through the lower and upper housings 15 and 17, respectively, and exiting the center housing 16, the lower housing includes a lower air inlet 91 and the upper housing and upper air inlet 92. Correspondingly, the center housing 16 is provided with an air outlet 93. The air inlets 91 and 92 and the air outlet 93 are disposed in the peripheral regions of the respective housing elements 15, 17 and 16 between the ends of their respective cooling water passages 61, 83 and 71. Thus, cooling air is caused to flow primarily through and past those areas which are not in direct heat transfer contact with the cooling water passages. Also, the air inlets and outlet lie directly adjacent the fuel intake and compression regions of the rotor housings which typically do not experience as high levels of operating temperature as the regions cooled directly by cooling water.

From the lower and upper air inlets 91 and 92, the cooling air flows upwardly and downwardly through the center openings in the rotor housings 13 and 14 and the rotors 11, and then through the central opening in the center housing 16 and out the air outlet 93. Cooling air discharged from the air outlet 93 may be circulated to the carburetors 94 attached to the rotor housings 13 and 14 to be mixed with fuel for the engine which enters the rotor chambers 30 through intake ports 95.

Figure 9:
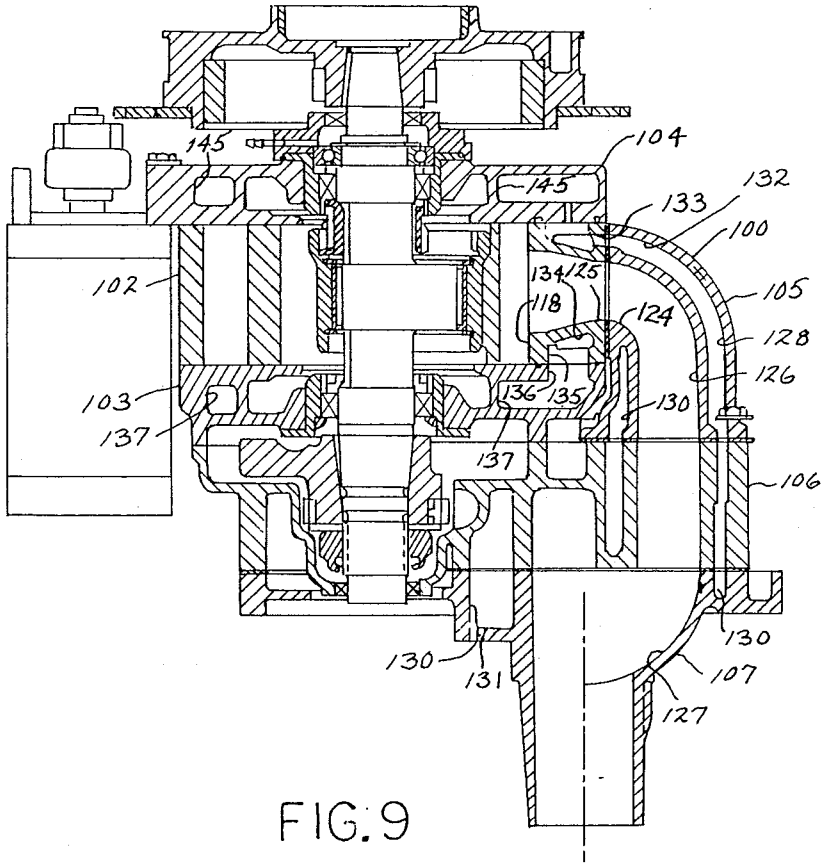
FIG. 9 is a vertical section taken on line 4—4 of FIG. 1, also showing the single rotor engine embodiment.
Figure 8:
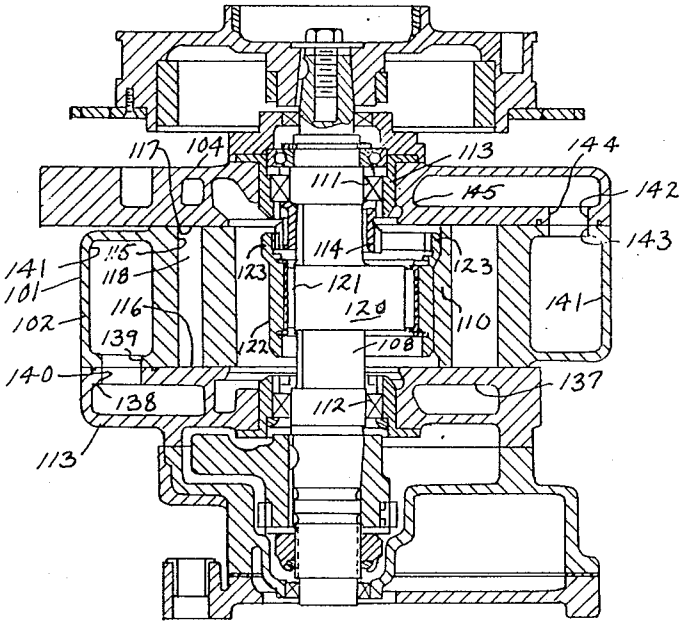
FIG. 8 is a vertical section taken on line 3—3 of FIG. 1, but showing a single rotor engine embodiment of the invention.

In a single rotor engine shown in FIGS. 8 and 9, the engine components are identical to those used in the twin rotor embodiment shown in FIGS. 1–7 and previously described, except for the rotor shaft and the exhaust housing. Also, of course, the single rotor engine has fewer components, namely, only a single rotor and rotor housing, and no center housing.

Referring particularly to FIGS. 8 and 9, the single rotor engine 100 includes an engine block 101 comprising a centrally disposed rotor housing 102 between a lower housing 103 and an upper housing 104. An exhaust manifold 105 is attached to the rotor housing 102 and extends downwardly for attachment to an adapter plate 106 and exhaust extension 107, in a manner similar to the previously described twin rotor embodiment. A rotor shaft 108 carrying a single rotor 110 is vertically disposed within the open center of the engine block 101. The rotor shaft 108 is mounted for rotation on upper and lower bearings 111 and 112, respectively. The outer face 113 of the upper bearing 111 includes an integral stationary gear 114. The rotor housing 102 has a central opening 115 which, with the underlying upper surface 116 of the lower housing 103 and the overlying lower surface 117 of the upper housing 104, defines a rotor chamber 118 within which rotor 110 operates.

As previously described with respect to the twin rotor embodiment, the rotor shaft 108 includes a cylindrical eccentric 120 on which the rotor 110 is rotatably journalled via a needle bearing assembly 121 mounted on a cylindrical ring 122 attached to the rotor. The cylindrical ring 122 includes an integral rotor gear 123 adapted to engage the stationary gear 114 and impart rotation to the rotor shaft 108 as a result of the rotor 110, all in a known manner.

The exhaust manifold 105 includes an upper exhaust inlet 124 which receives hot exhaust gases from an exhaust outlet 125 extending through the rotor housing 102 from the rotor chamber 118. Hot exhaust gases pass downwardly through an exhaust passage 126 in the exhaust manifold, into an exhaust chamber 127 in the adapted plate 106 and exhaust extension 107 for discharge into an exhaust tube in the lower drive shaft housing (not shown).

An integral cooling water jacket 128 surrounds the exhaust passage 126 in the exhaust manifold 105. Similarly, an integral cooling water chamber 130 surrounds the exhaust chamber 127 in the adaptor plate 106 and exhaust exterior 107. Cooling water is supplied to the engine via a cooling system water inlet 131 from which the water flows by pump pressure upwardly through cooling water chamber 130 and cooling water jacket 128, and from which it passes out of the water jacket outlet 132 into a cooling water inlet 133 in the rotor housing 102. Cooling water entering the rotor housing via the cooling water inlet 133 flows downwardly through an annular chamber 134 surrounding the exhaust outlet 125. Cooling water exits the bottom of annular chamber 134 via a cooling water outlet 135 and enters the lower housing 103 through the directly aligned cooling water inlet 136.

As in the twin rotor embodiment described above, the lower housing includes an internal peripheral cooling water passage 137 extending circumferentially around a portion of the housing from the cooling water inlet 136 to an upper cooling water outlet 138. Upper outlet 138 is aligned with a lower outlet 139 to the rotor housing 102 which, in combination, comprise a transfer passage 140 between the adjacent housing 103 and 102.

The lower inlet 139 opens into the rotor housing cooling water passage 141 extending around a peripheral portion of the rotor chamber 30. Cooling water exits the rotor housing and enters the upper housing 104 via a transfer passage 142 comprising a combination of aligned upper outlet 143 from cooling water passage 141 and a lower inlet 144 leading to a cooling water passage 145 in the upper housing 104. The cooling water passage 145 in the upper housing also extends generally circumferentially around a peripheral portion of the housing. Cooling water passage 145 includes a discharge outlet 146 located near its downstream end, which outlet is connected to a discharge conduit 147 for discharge of the heated cooling water into the drive shaft housing of the outboard motor.

The single rotor engine 100 also includes a small diameter air vent 148 between the upper portion of the annular chamber 134 surrounding the exhaust outlet 125 and the cooling water passage 145 in the upper housing. The vent 148 provides for the release of trapped air or steam in a manner previously described.

Supplemental air cooling of the engine may also be provided in a manner similar to the twin rotor embodiment. However, without a center housing member, cooling air is taken in through either the upper or lower housing and exits via the other. Thus, cooling air may be brought into the engine via an upper air inlet 150 in the upper housing 104 and discharged via a lower air outlet 151 in the lower housing 103. Intake air flows downwardly through the center opening in the rotor housing 102 and the openings in the rotor 110 before exiting through the lower air outlet.

In both the twin rotor engine 10 and the single rotor engine 100, the initial intake of engine cooling water is supplied first to the water jacket surrounding the outer surface of the exhaust manifold before being directed to the inlet in the rotor housing adjacent to and surrounding the exhaust gas outlet. The cooling water is then directed downwardly to the cooling water passage in the lower housing from which it follows an upwardly directed serpentine path to completely cool the entire high temperature area of the engine block, namely, the combustion and exhaust regions of the various engine housing components.

We claim:

1. In a rotary engine for an outboard motor having a composite engine block including a lower housing, an intermediate rotor housing and an upper housing, said housings defining a generally central opening including a rotor chamber, and an exhaust manifold attached to the outside of the engine block adjacent an exhaust gas outlet in the rotor chamber, an improved engine cooling system comprising:

a cooling water jacket disposed around the outer surface of the exhaust manifold;

a first inlet in one end of the cooling water jacket for supplying cooling water thereto;

a first outlet in the other end of the cooling water jacket for discharging cooling water therefrom;

a second inlet in the rotor housing adjacent the exhaust gas outlet and in operative communication with the first outlet for receiving cooling water from the cooling water jacket;

cooling water passage means circumferentially disposed along a peripheral portion of each of the housings and extending generally adjacent the combustion and exhaust regions of the rotor chamber;

transfer passage means serially interconnecting one end of each cooling water passage means with the end of an adjacent cooling water passage means;

a third inlet in the upstream end of said serially interconnected cooling water passage means for receiving cooling water from the rotor housing;

a discharge outlet in the downstream end of said serially interconnected cooling water passage means for discharging cooling water from the system;

an annular chamber connected to the second inlet and surrounding the exhaust gas outlet;

a second outlet at the lower end of the annular chamber in open communication with the third inlet; and, vent means in the upper portion of the annular chamber in communication with the cooling water passage means in the upper housing.

2. The invention as set forth in claim 1 wherein said vent means comprises an air and steam vent hole in the lower wall of the upper housing, said vent hole opening directly into the annular chamber.

3. In a twin rotor water-cooled rotary engine having an upper rotor housing and a lower rotor housing each including a central opening defining a rotor chamber, a center housing member between the rotor housings, an upper housing attached to the upper side of the upper rotor housing, a lower housing attached to the lower side of the lower rotor housing, a vertically extending rotor shaft carrying a pair of rotors for rotation within the respective rotor chambers, an exhaust gas outlet extending through the outer wall of each rotor housing from the rotor chamber, and an exhaust manifold attached to the rotor housings and having upper and lower exhaust discharge passages in respective communication with said exhaust gas outlets, an improved water cooling system comprising:

a cooling water jacket surrounding the outer surface of the exhaust manifold;

a first inlet in the cooling water jacket for supplying a flow of cooling water thereto;

a primary outlet in the cooling water jacket for discharging cooling water to said upper rotor housing;

a secondary outlet in the cooling water jacket for discharging cooling water to said lower rotor housing;

a primary inlet in the upper rotor housing adjacent the exhaust gas outlet therein and in communication with said primary outlet for receiving cooling water;

a secondary inlet in the lower rotor housing adjacent the exhaust gas outlet therein and in communication with said secondary outlet for receiving cooling water;

cooling water passage means circumferentially disposed along a peripheral portion of each of the housings and extending generally adjacent the combustion and exhaust regions of the rotor chambers;

transfer passage means serially interconnecting one end of each cooling water passage means with the end of an adjacent cooling water passage means;

third inlet means in the upstream end of said serially interconnected cooling water passage means for receiving cooling water from the primary inlet;

a discharge outlet in the downstream end of said serially interconnected cooling water passage means for discharging cooling water from the system; and, wherein said secondary inlet is substantially smaller than said primary inlet and receives a substantially smaller volume of the cooling water flow from said jacket.

* * * * *